US011367401B2

(12) United States Patent
Kim

(10) Patent No.: US 11,367,401 B2
(45) Date of Patent: Jun. 21, 2022

(54) METHOD FOR DRIVING DISPLAY

(71) Applicant: Taehyun Kim, Busan (KR)

(72) Inventor: Taehyun Kim, Busan (KR)

( * ) Notice: Subject to any disclaimer, the term of this patent is extended or adjusted under 35 U.S.C. 154(b) by 0 days.

(21) Appl. No.: 17/283,946

(22) PCT Filed: Nov. 21, 2019

(86) PCT No.: PCT/KR2019/015991

§ 371 (c)(1),
(2) Date: Apr. 8, 2021

(87) PCT Pub. No.: WO2020/106066

PCT Pub. Date: May 28, 2020

(65) Prior Publication Data

US 2021/0383761 A1 Dec. 9, 2021

(30) Foreign Application Priority Data

Nov. 21, 2018 (KR) ..... 10-2018-0144806

(51) Int. Cl.
*G09G 3/3266* (2016.01)

(52) U.S. Cl.
CPC ... *G09G 3/3266* (2013.01); *G09G 2310/0213* (2013.01); *G09G 2330/021* (2013.01)

(58) Field of Classification Search
CPC ..... G09G 3/3266; G09G 2310/0213; G09G 2330/021
See application file for complete search history.

(56) References Cited

U.S. PATENT DOCUMENTS

2004/0032213 A1* 2/2004 Kim ..... G09G 3/3216 315/169.1
2014/0009458 A1 1/2014 Nam et al.
2016/0240146 A1* 8/2016 Lee ..... G09G 3/2003

FOREIGN PATENT DOCUMENTS

JP 2016-151765 A 8/2016
KR 10-2004-0016467 A 2/2004
KR 10-2012-0076178 A 7/2012
KR 10-2016-0094560 A 8/2016
KR 20160094560 A * 8/2016

* cited by examiner

*Primary Examiner* — Kenneth B Lee, Jr.
(74) *Attorney, Agent, or Firm* — Maschoff Brennan

(57) ABSTRACT

Disclosed is a method for driving a display, comprising the steps of: turning on one scan line from among a plurality of scan lines so as to drive a pixel connected to the scan line through a plurality of source lines; and turning off the scan line, and then turning on a scan line spaced apart from the scan line with at least one column there between, so as to drive a pixel connected to the scan line through a plurality of source lines.

5 Claims, 5 Drawing Sheets

METHOD FOR DRIVING DISPLAY

TECHNICAL FIELD

The present disclosure generally relates to a method of driving a display, and more particularly, to a method of driving a display to reduce the power consumption.

BACKGROUND ART

Herein, this section provides background information related to the present disclosure which is not necessarily prior art.

Demands for an AMOELD screen are increasing due to requests for a high contrast and a flexible display in a mobile phone and a small display device. Due to the characteristics of the AMOLED, pixel compression using a sub pixel rendering (SPR) scheme is required for implementing high resolution (high PPI).

FIG. 1 is a diagram showing an example of a pixel arrangement by the SPR scheme, in which red sub-pixels 1R-1, 1R-2, 2R-1, and 2R-2 and blue sub-pixels 1B-1, 1B-2, 2B-1, 2B-2 are alternately arranged with each other in vertical and horizontal directions, and a green sub-pixel 1G-1 is arranged between the two red sub-pixels 1R-1 and 2R-1 and the two blue sub-pixels 1B-1 and 2B-1. The red sub-pixel 1R-1, the blue sub-pixel 1B-1, and the green sub-pixel 1G-1 form a pixel 10, the blue sub-pixel 1B-1, the red sub-pixel 1R-2, and the green sub-pixel 1G-2 form a pixel 20, and the red sub-pixel 1R-2, the blue sub-pixel 1B-2, and the green sub-pixel 1G-3 form a pixel 30.

FIG. 2 is a diagram for explaining an example of a method of scan-driving the pixel arrangement shown in FIG. 1, in which source lines Source1, . . . , and Source N are provided to columns, and scan lines Scan1, . . . , and Scan M are provided to rows, respectively. Only the green sub-pixels 1G-1 are connected in the source line Source2, and the red sub-pixels 1R-1 and 2R-1 and the blue sub-pixels 1B-1 and 2B-1 are alternately connected in the source line Source1. Meanwhile, the red sub-pixel 1R-1, the green sub-pixel 1G-1, and the blue sub-pixel 1B-1 are sequentially and repeatedly arranged in odd-numbered rows, and the blue sub-pixel 2B-1, the green sub-pixel 2G-1, and the red sub-pixel 2R-1 are sequentially and repeatedly arranged in even-numbered rows. When a scheme of inputting pixel display data required for the source lines Source1, . . . , and Source N while sequentially turning on the scan-driving (scan lines Scan1, . . . , and Scan M) is used for the above pixel arrangement (see FIG. 3 for a scan driving circuit diagram), a voltage for a red sub-pixel and a voltage for a blue sub-pixel are required to be alternately applied to one source line. For example, when red colors are displayed over the whole screen, a low voltage for turning on red sub-pixels and a high voltage for turning off blue sub-pixels are required to be alternately applied to the source line, the voltage change becomes large and accordingly the current consumption is increased. In particular, the power consumption problem of the source line is serious in an environment driven with small power consumption at low luminance such as always-on-display (AOD). Further, since the existing drive of a 60 Hz frame rate causes a ghost phenomenon in which an image is dragged on a display during a game or the like that has images changed very quickly, a drive with 120 Hz has been requested. However, since a time for charging the display data is insufficient, there are many technical difficulties in realizing the frame rate of 90-120 Hz.

DISCLOSURE

Technical Problem

The technical problem will be described at the end of "Mode for Invention".

Technical Solution

Herein, this section provides a general summary of the disclosure and is not a comprehensive disclosure of its full scope or all of its features.

One aspect of the present disclosure provides a method of driving a display including a plurality of pixels (the pixels are arranged in a plurality of rows and a plurality of columns) and using a plurality of scan lines connected to rows and a plurality of source lines connected to columns, respectively, which includes: turning on one scan line from among a plurality of scan lines so as to drive a pixel connected to the scan line through a plurality of source lines; and turning off the scan line, and then turning on a scan line spaced apart from the scan line with at least one column there between, so as to drive a pixel connected to the scan line through a plurality of source lines.

Advantageous Effects

The advantageous effects will be described at the end of "Mode for Invention".

BEST MODE

Mode for Invention

Hereinafter, the present disclosure will now be described in detail with reference to the accompanying drawing(s).

Figure 4:
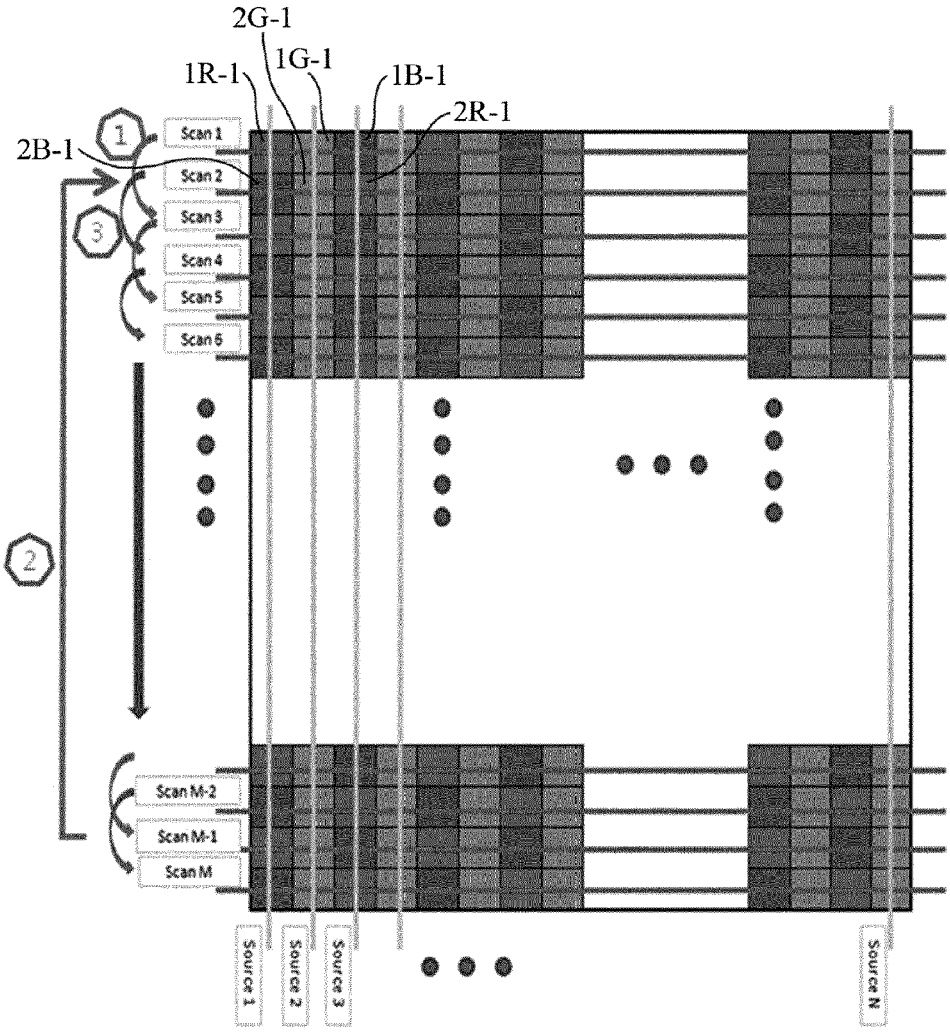
FIG. 4 is a view showing an example of a method of performing a scan-driving according to the present disclosure.

FIG. 4 is a view showing an example of a method of performing a scan-driving according to the present disclosure. In order to solve the problems of the conventional scan-driving, instead of sequentially turning on and off the scan lines Scan1, . . . , Scan M, scan lines having sub-pixels of the same color (odd-numbered scan lines such as scan lines Scan1, Scan3, Scan5, . . . , or even-numbered scan lines such as scan lines Scan2, Scan4, Scan6, . . . ) are driven as being sequentially turned on and off, and subsequently, the remaining scan lines are sequentially driven as being turned on and off. The scan lines are operated in the above manner, such that the voltage required for the red sub-pixel may be applied to the source lines Source1, . . . , and Source N to perform the operation when the odd-numbered scan lines Scan1, Scan3, Scan5, . . . are driven, and the voltage required for the blue sub-pixel may be applied to the source lines Source1, . . . , Source N to perform the operation when even-numbered scan lines Scan2, Scan4, Scan6, . . . are driven. When the driving is performed in the above manner, a swing of an output voltage of the source line is minimized, so that the power consumption of the source line may be significantly reduced. The operation for the odd-numbered scan lines Scan1, Scan3, Scan5, . . . and the even-numbered scan lines Scan2, Scan4, Scan6, . . . may be basically applied to one frame, but the operation for the odd-numbered scan lines Scan1, Scan3, Scan5, . . . and the even-numbered scan lines Scan2, Scan4, Scan6, . . . may be applied to two consecutive frames, so that there is the effect of doubling the driving speed for the frames. Meanwhile, the source line data used for operating the odd-numbered scan lines Scan1, Scan3, Scan5, . . . is separated from the source line data used for operating the even-numbered scan lines Scan2, Scan4, Scan6, . . . , so that the efficiency of data transmission may be increased in a device, such as a smartphone, having limited resources.

Figure 2:
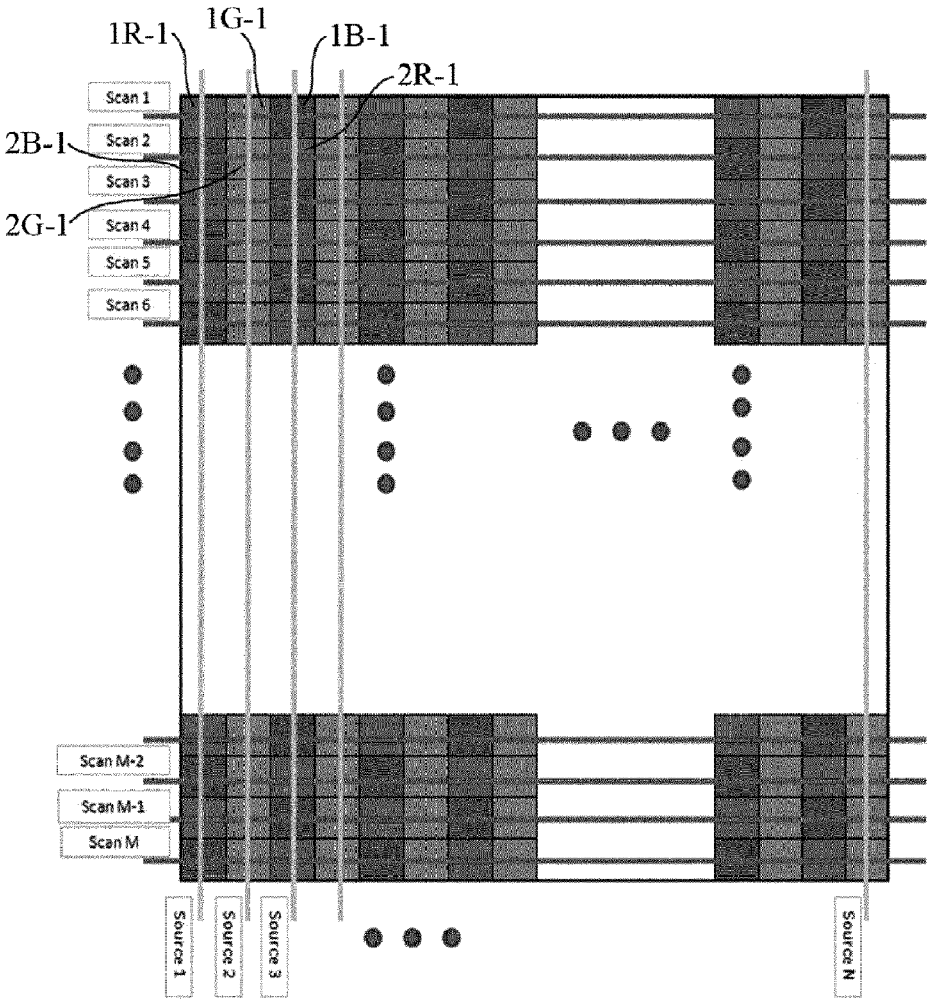
FIG.2 Prior Art
FIG. 2 is a diagram for explaining an example of a method of scan-driving the pixel arrangement shown in FIG. 1.
Figure 3:
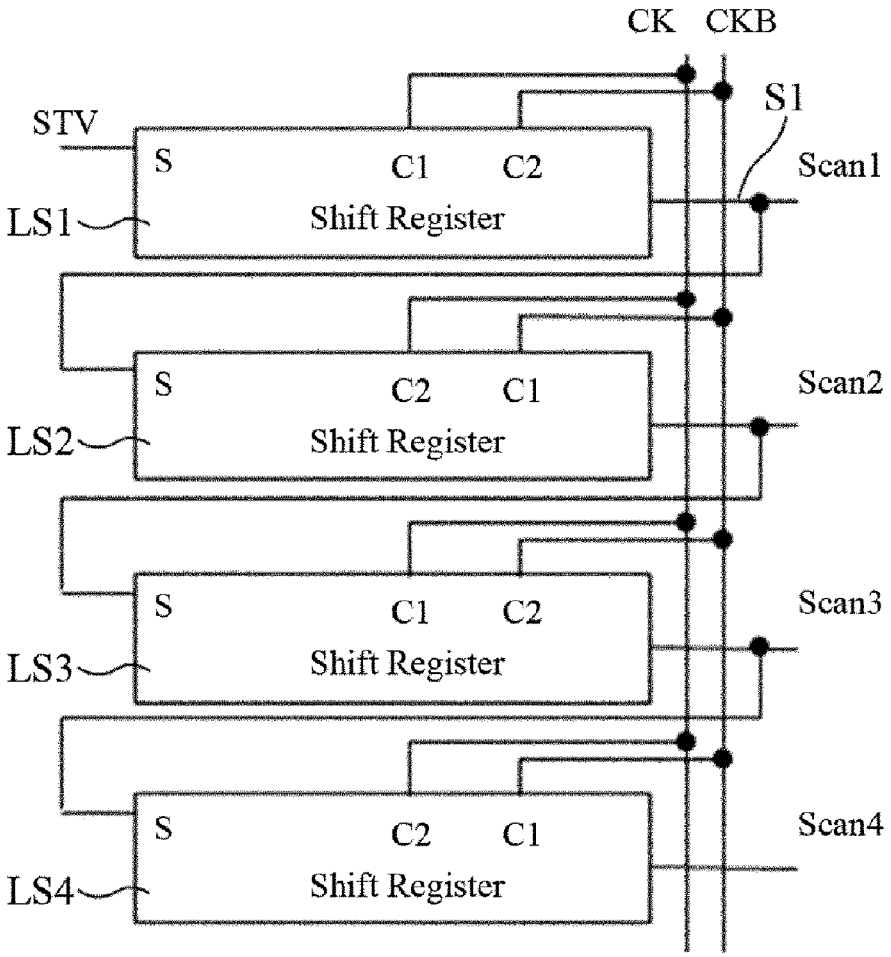
FIG.3 Prior Art
FIG. 3 is a view showing an example of a conventional scan-driving circuit diagram.

FIG. 3 is a view showing an example of a conventional scan-driving circuit diagram, in which level shifters LS1, LS2, LS3, LS4, . . . are provided to the scan lines Scan1, Scan2, Scan3, Scan4, . . . , respectively. When a start signal STV comes into the level shifter LS1 connected to the scan line Scan1, a signal S1 is generated to correspond to a driving of a combination of a clock CK and a clock inversion signal CKB, so that the scan line Scan1 may be turned on and turned off in a predetermined period of time. The signal S1 is inputted to the level shift LS2 immediately disposed there below, and the scan line Scan2 is turned on to correspond to a driving of a combination of CK and CKB, and turned off in a predetermined period of time. When the signals are sequentially transmitted to the last scan line Scan M (see FIG. 2) in the above manner, display data of one frame is saved, and the start signal STV is outputted again, thereby repeatedly storing the display data, so that the desired image is displayed.

Figure 5:
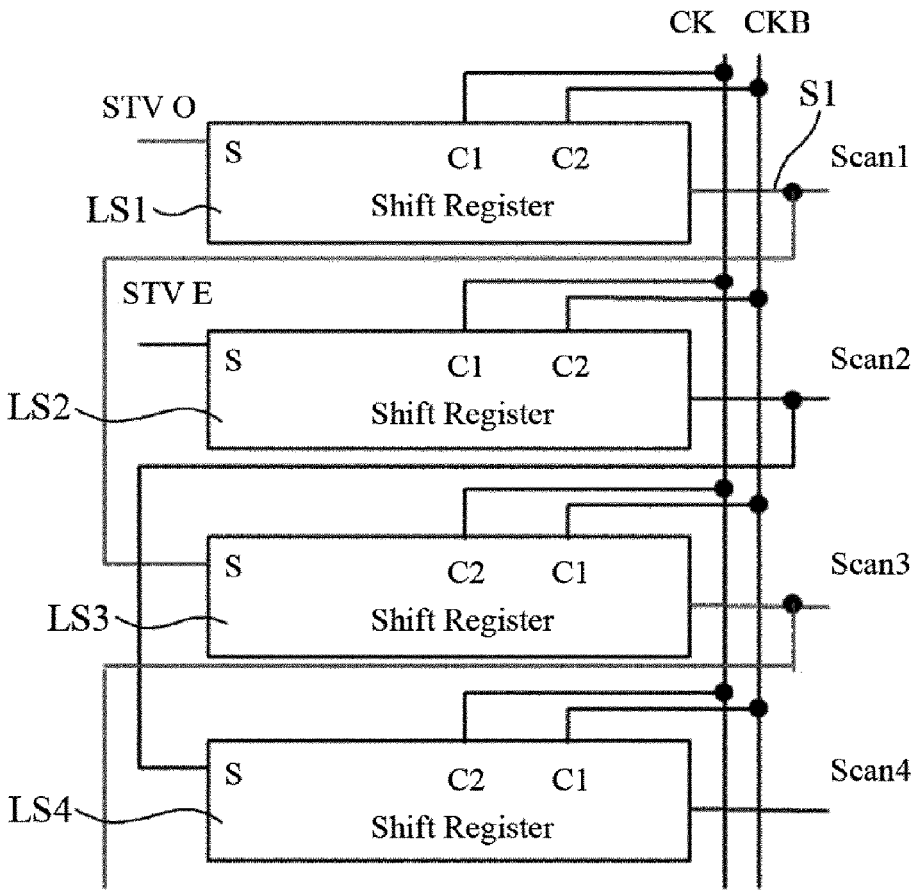
FIG. 5 is a view showing an example of the conventional scan-driving circuit diagram.

FIG. 5 is a view showing an example of the scan driving circuit diagram according to the present disclose. Unlike FIG. 3, two start signals STVO and STVE are used. After passing through the level shifter LS1, the start signal STVO is transferred not to the level shifter LS2 but to the level shifter LS3, and the signal is transferred to the last odd-numbered level shifter. Then, a start signal STVE is sent and transferred to the last even-numbered level shifter through the level shifter LS2 and the level shifter LS4. The start signal STVE may be generated as a signal separated from the start signal STVE, and the signal having passed through the last odd-numbered level shifter may also be used as the start signal STVE. The odd-numbered scan lines may be driven first, however, the even-numbered scan lines may be driven first.

Hereinafter, various embodiments of the present disclose will be described.

Figure 1:
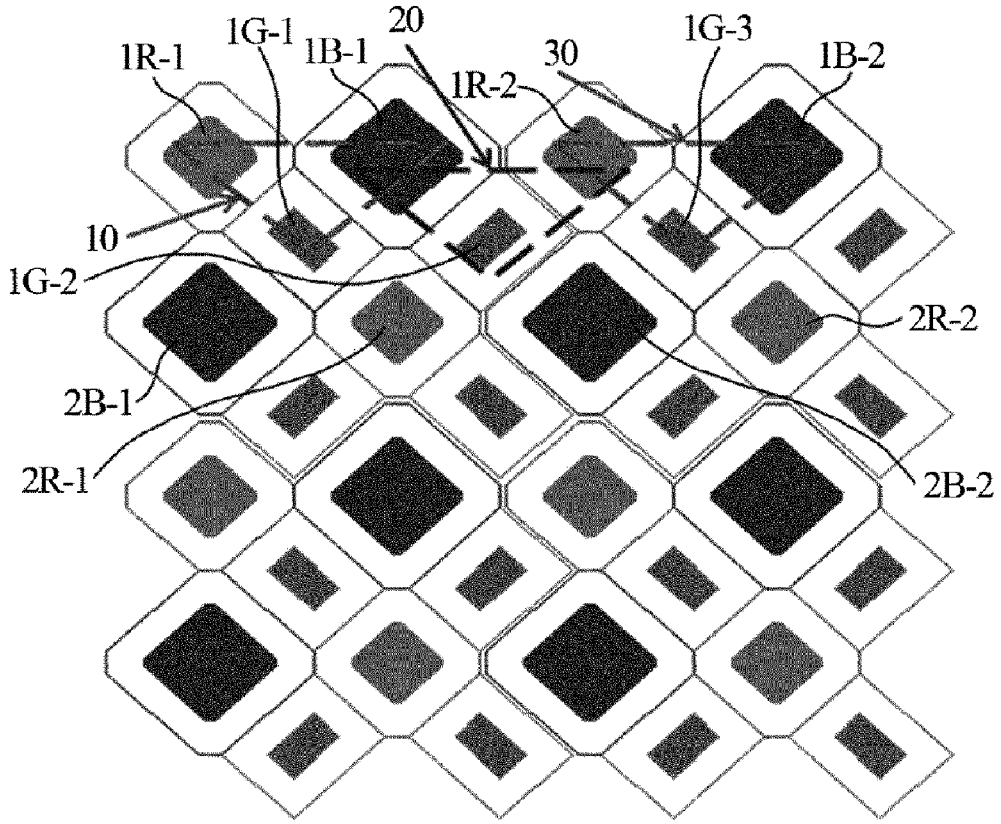
FIG.1 Prior Art
FIG. 1 is a diagram showing an example of a pixel arrangement by an SPR scheme.

(1) In a method of driving a display including a plurality of pixels (the pixels are arranged in a plurality of rows and a plurality of columns) and using a plurality of scan lines connected to rows and a plurality of source lines connected to columns, respectively, a method of driving a display including: turning on one scan line from among a plurality of scan lines so as to drive a pixel connected to the scan line through a plurality of source lines; and turning off the scan line, and then turning on a scan line spaced apart from the scan line with at least one column there between, so as to drive a pixel connected to the scan line through a plurality of source lines. Herein, the pixel refers to a concept including all of the pixels and sub-pixels described with reference to FIG. 1.

(2) The method of driving the display, wherein scan lines corresponding to odd-numbered rows or scan lines corresponding to even-numbered rows are combined and driven first.

(3) The method of driving the display, wherein the pixels include a plurality of first pixels for generating a first color and a plurality of second pixels for generating a second color different from the first color, the first pixels are connected to the second pixels in one source line, and the first pixels or the second pixels are combined and driven first.

(4) The method of driving the display, wherein the scan lines corresponding to the odd-numbered rows and the scan lines corresponding to the even-numbered rows are sequentially driven along rows, respectively.

(5) The method of driving the display, wherein a driving for each of the scan lines corresponding to the odd-numbered rows and the scan lines corresponding to the even-numbered rows displays one frame.

(6) The method of driving the display, wherein display data for each of the scan line corresponding to the odd-numbered row and the scan line corresponding to the even-numbered row is separately transmitted and driven.

(7) The method of driving the display, wherein the pixels include a plurality of third pixels for generating a third color different from the first color and the second color, the third pixels are provided to one source line disconnected to the first pixels and the second pixels, pixels positioned on the scan lines corresponding to the odd-numbered rows generate the first color, and pixels positioned on the scan lines corresponding to the even-numbered rows generate the second color.

(8) The method of driving the display, wherein different start signals are used for the scan lines corresponding to the odd-numbered rows and the scan lines corresponding to the even-numbered rows.

(9) The method of driving the display, wherein one start signal is used for each of the scan lines corresponding to the odd-numbered rows and the scan lines corresponding to the even-numbered rows.

In the method of driving one display according to the present disclosure, and in a display using the scan-driving, particularly a display using the AMOLED, the power consumption can be reduced, the frame speed can be improved, and the transmission speed of the pixel display data can be improved.

INDUSTRIAL APPLICABILITY

Description of Reference Numerals

The invention claimed is:

1. A method of driving a display including a plurality of pixels (the pixels are arranged in a plurality of rows and a plurality of columns) and using a plurality of scan lines connected to rows and a plurality of source lines connected to columns, respectively, the method comprising:

turning on one scan line from among a plurality of scan lines so as to drive a pixel connected to the scan line through a plurality of source lines; and turning off the scan line, and then turning on a scan line spaced apart from the scan line with at least one column there between, so as to drive a pixel connected to the scan line through a plurality of source lines, wherein:

the pixels include a plurality of first pixels for generating one of a red color and a blue color, and a plurality of second pixels for generating a remainder of a red color and a blue color, the first pixels are connected to the second pixels in one source line, and a plurality of first pixels are arranged in odd numbered rows and a plurality of second pixels are arranged in even numbered rows, and the scan lines corresponding to the odd-numbered rows and the scan lines corresponding to the even-numbered rows are sequentially driven for one frame along the rows, respectively.

2. The method of claim 1, wherein display data for each of the scan lines corresponding to the odd-numbered row and the scan lines corresponding to the even-numbered row is separately transmitted and driven.

3. The method of claim 1, wherein the pixels include a plurality of third pixels for generating a third color different from a first color and a second color, the third pixels are provided to one source line disconnected to the first pixels and the second pixels, pixels positioned on the scan lines corresponding to the odd-numbered rows generate the first color, and pixels positioned on the scan lines corresponding to the even-numbered rows generate the second color.

4. The method of claim 1, wherein different start signals are used for the scan lines corresponding to the odd-numbered rows and the scan lines corresponding to the even-numbered rows.

5. The method of claim 1, wherein one start signal is used for each of the scan lines corresponding to the odd-numbered rows and the scan lines corresponding to the even-numbered rows.

* * * * *